US005111725A

United States Patent [19]

Simpson et al.

[11] Patent Number: 5,111,725

[45] Date of Patent: May 12, 1992

[54] SCRAP EJECTOR FOR ROTARY DIE CUTTING APPARATUS

[75] Inventors: Jack R. Simpson, Raleigh; Jeffrey A. Geer, Apex, both of N.C.

[73] Assignee: Container Graphics Corporation, Cary, N.C.

[21] Appl. No.: 709,922

[22] Filed: May 31, 1991

[51] Int. Cl.[5] ..... B26D 7/18

[52] U.S. Cl. ..... 83/117; 83/119; 493/342; 493/472

[58] Field of Search ..... 83/113, 115, 116, 117, 83/118, 119, 120, 123, 128, 347; 493/472, 342, 373

[56] References Cited

U.S. PATENT DOCUMENTS

| | | | |
|---|---|---|---|
| 336,335 | 2/1886 | McDonald | 83/134 |
| 545,711 | 9/1895 | Miller | 83/134 |
| 1,473,089 | 11/1923 | Faust | 83/134 |
| 1,751,562 | 3/1930 | Stinger | 83/115 |
| 1,983,708 | 12/1934 | Ruble et al. . | |
| 2,327,530 | 8/1943 | Klopfenstein | 83/134 |
| 2,899,871 | 8/1959 | Auer . | |
| 3,186,274 | 6/1965 | Winkler et al. | 83/117 |
| 3,499,370 | 3/1970 | Kulwicki et al. . | |
| 3,807,262 | 4/1974 | Vits | 83/117 |
| 3,946,627 | 3/1976 | Hofmann | 83/117 |
| 4,224,851 | 9/1980 | Imai | 83/117 |
| 4,306,476 | 12/1981 | Saunders et al. | 83/117 |
| 4,896,573 | 1/1990 | Kapolnek | 83/117 |

*Primary Examiner*—Douglas D. Watts
*Assistant Examiner*—Eugenia A. Jones
*Attorney, Agent, or Firm*—Bell, Seltzer, Park & Gibson

[57] ABSTRACT

The scrap ejector has a relatively long and thin body made of stainless steel or other resilient and durable material. The leading end portion of the body overlies and is secured to the outer surface of the die roll. In its undeflected condition, the trailing end portion of the body is spaced radially from the die roll. In one embodiment the body has a pad of compressible elastomer upon the surface thereof distal from the die roll, and in another embodiment the body has an arcuate portion projecting from the aforesaid surface of the body. During passage of the scrap ejector through the nip between the die and anvil rolls engagement between the anvil roll and the resilient pad (in the first embodiment) or the arcuate portion (in the second embodiment) deflects the trailing end portion of the body to a position wherein its terminal end is closely adjacent the surface of the die roll and the leading surface of the cutting rule which trims the leading edge portion of the paperboard stock. Upon passage from the nip, the leading end portion of the body springs outwardly and ejects from the apparatus the scrap material produced by the trimming operation. The edges of the body preferably are rounded and smooth.

16 Claims, 5 Drawing Sheets

Fig. 1.
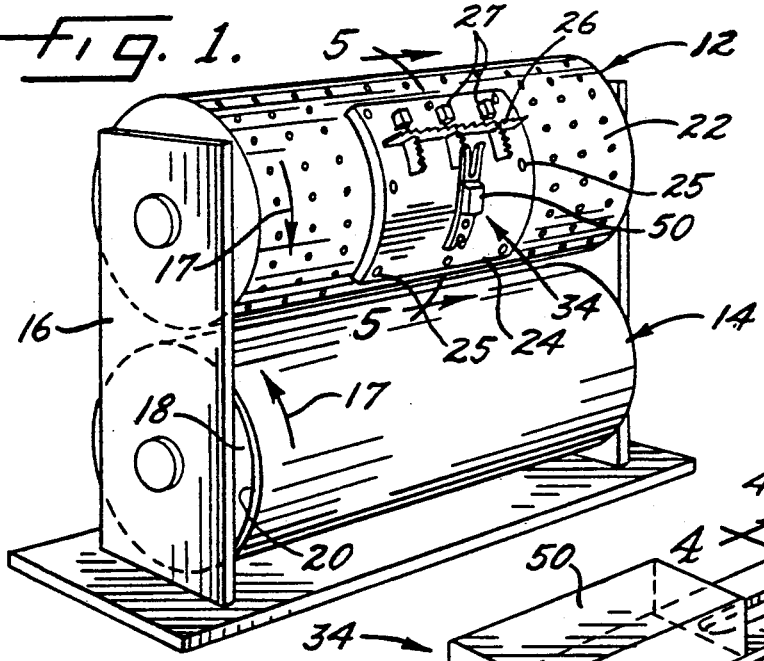
Fig. 3.
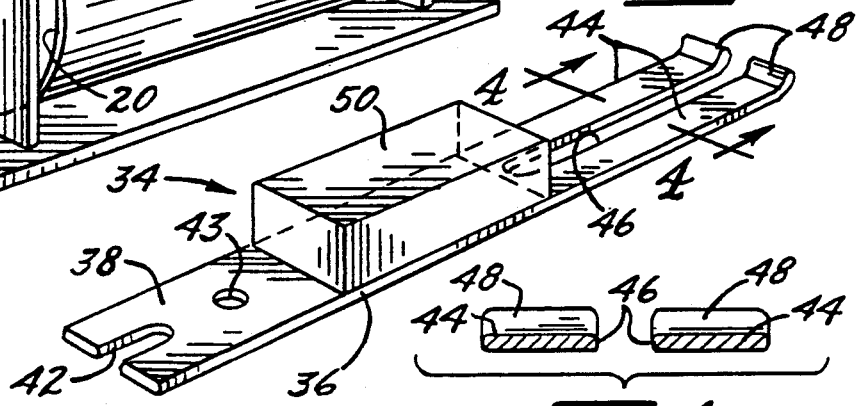
Fig. 4.
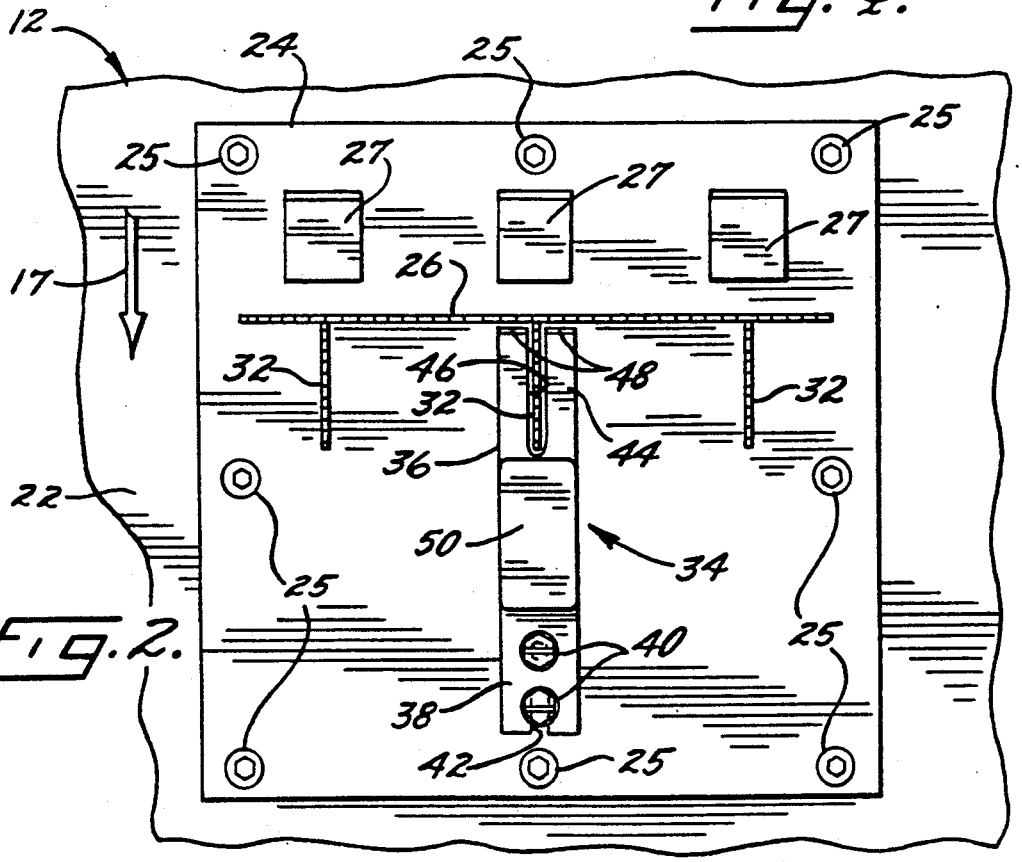
Fig. 2.

SCRAP EJECTOR FOR ROTARY DIE CUTTING APPARATUS

FIELD OF THE INVENTION

This invention relates to rotary die apparatuses for cutting corrugated paperboard or similar material during passage thereof through the nip between counter-rotating die and anvil rolls of the apparatus. The invention more specifically relates to improved means for ejecting from the apparatus scrap material cut from the leading edge portion of the paperboard stock.

BACKGROUND OF THE INVENTION

Rotary die apparatuses having counter-rotating die and anvil rolls are commonly used in the manufacture of cartons or boxes to trim or otherwise cut corrugated paperboard stock to a desired shape. One frequently performed trimming operation cuts away the leading edge portion of the paperboard stock. The leading edge portion is cut away by a "primary" cutting rule that extends radially outwardly from the die roll, and usually is substantially parallel to the central axis of the roll. The die roll may and frequently does also have a plurality of relatively short "trim breaker" rules that are spaced from each other along the length of the primary cutting rule and extend forwardly therefrom for the purpose of cutting the scrap leading edge portion into sections of shorter length.

The rotary die apparatus now commonly employed for cutting away the leading edge portion of the paperboard stock customarily includes at least one and usually a plurality of blocks of so-called "scrap ejection" rubber. The rubber blocks are mounted upon and extend outwardly from the curved surface of the die board of the die roll, at locations forwardly (in relation to the direction of rotation of the roll) of and closely adjacent to the primary cutting rule. In their uncompressed condition the rubber blocks project radially outwardly beyond the toothed cutting edge of the rule. The blocks are compressed as they pass into and through the nip between the die and anvil rolls. As they pass from such nip, return outward movement of the blocks is supposed to eject the cut leading edge portion of the paperboard stock downwardly away from the path of travel of the stock.

Unfortunately, however, a number of undesirable consequences may arise during use of scrap ejection means of the aforesaid conventional type. The rubber blocks may so impede the cutting action of the cutting rule as to cause pieces of the leading edge portion of the paperboard stock to remain attached to the main body of the paperboard. This is particularly likely to happen if the nip spacing between the die and anvil rolls is not properly adjusted for the particular paperboard stock being cut. The rubber blocks may alternatively or additionally drive pieces of the severed leading edge portion of the stock with such force against the urethane outer layer of the anvil roll as to cause them to adhere to the anvil roll until rotary movement of the latter carries the scrap to a position from which they are discharged onto the upper surface of the paperboard stock. In either of the aforesaid situations, the scrap paperboard may be carried with the cut paperboard product to a stacking machine downstream from the die apparatus, and may therefore eventually wind up within the carton, box or the like formed from the paperboard. This can have very undesirable consequences, particularly when the carton or box is used for foods, such as pizza, which can be contaminated by the scrap paperboard. Scrap contamination of the carton or box can also ensue when the blocks of product ejection rubber do not extend rapidly enough, as they exit from the nip between the rolls of the apparatus, to prevent the paperboard stock from advancing beneath the trimmed scrap, and then being transported by the cut paperboard stock to the packing machine.

In addition to possibly causing intermingling of the scrap material with the cut paperboard product, the use of product ejection means of the aforesaid type can cause severe structural damage to the die roll of the apparatus. This may occur when the leading edge portion of the paperboard stock engages the radially extending trailing surface of one or more of the rubber blocks with a force sufficient to displace the rubber block forwardly away from the adjacent cutting rule. Apart from possibly causing the scrap to be carried forward with the cut paperboard product, and/or causing buckling of the product's new forward end portion, the scrap material may enter into the space between the cutting rule and the forwardly deflected rubber block. As additional scrap material enters the aforesaid space during continued operation of the apparatus, the force exerted upon the cutting rule may become so great as to deflect the rule rearwardly and cause ensuing bending of the rule and/or crushing of the thereto adjacent portions of the wooden laminated die board upon which the rule is mounted. When this occurs, the apparatus must be removed from service while the damaged rule and/or die board are replaced.

DESCRIPTION OF THE PRIOR ART

The following U.S. Pat. Nos. may be of interest relative to the present invention: U.S. Pat. Nos. 336,335, 545,711, 1,473,089, 1,983,708, 2,327,530, 2,899,871, 3,186,274, 3,499,370, 3,807,262, 3,946,627, 4,224,851, and 4,896,573.

SUMMARY OF THE INVENTION

The present invention provides an improved ejector for ejecting scrap cut from the leading edge portion of paperboard stock during its passage through the nip between counter-rotating die and anvil rolls of a rotary die cutting apparatus. In a preferred embodiment thereof, the scrap ejector includes a relatively long and thin main body formed of springy stainless steel or other resilient and durable material. The leading (in relation to the direction of rotation of the die roll) end portion of the ejector body is fixedly secured to the arcuate outer surface of the die roll. The opposite, trailing end portion of the body normally is spaced radially outwardly from the aforesaid die roll surface. Resiliently compressible and extendable means, which in one embodiment is a pad of closed cell elastomer, is secured to and projects from the radially outer surface of the body. During passage of the scrap ejector through the nip between the roll, engagement between the pad member and the anvil roll forces the trailing end portion of the body to a position closely adjacent the outer surface of the die roll and the leading surface of the cutting rule. As the scrap ejector exits from the nip, its trailing end portion undergoes resilient return movement away from the die roll and ejects the scrap cut leading edge portion of the paperboard material downwardly away from the path of travel of the trimmed paperboard stock. The pad of compressible resilient material upon the outer surface of the main body member of the device decreases the magnitude of the shock forces imposed upon the main body member during its engagement with the anvil roll. This enhances the useful life of the ejector. In addition, the pad of compressible material permits successful performance of the cutting and scrap ejecting operations even if the spacing between the die and anvil rolls in the nip area is other than optimum.

When the die roll of the apparatus includes one or more trim breakers extending forwardly from the leading cutting rule, the trailing end portion of each or any selected one of the ejector devices may have a slot which receives the trim breaker when the main body of the ejector device is inwardly deflected. A smaller slot may also be provided within the leading end portion of the main body of the device for the purpose of facilitating initial mounting of the device in an optimum position upon the arcuate surface of the die roll. In an alternative embodiment the leading end portion of ejector body has an angularly extending mounting flange that is received within a slot in the die board.

In another embodiment the undeflected main body of the ejector device is curved, rather than straight, and has intermediate its length a resiliently compressible arcuate "hump" that engages the anvil roll and deflects the trailing end of the body inwardly toward the surface of the die roll as the body enters the nip between the rolls.

DESCRIPTION OF THE DRAWINGS

Other features of the invention will be apparent from the following description of a preferred embodiment thereof, which should be read in conjunction with the accompanying drawings in which:

FIG. 1 is a partially schematic perspective view of a rotary die apparatus in accordance with the invention;

FIG. 2 is an enlarged fragmentary plan view of the die roll of the apparatus, and of a scrap ejector and other components upon the die board of the die roll;

FIG. 3 is a perspective view of the scrap ejector of the apparatus;

FIG. 4 is a sectional view taken along the line and in the directions of the arrows 4—4 through the scrap ejector of FIG. 3;

DESCRIPTION OF THE PREFERRED EMBODIMENT

Figure 5:
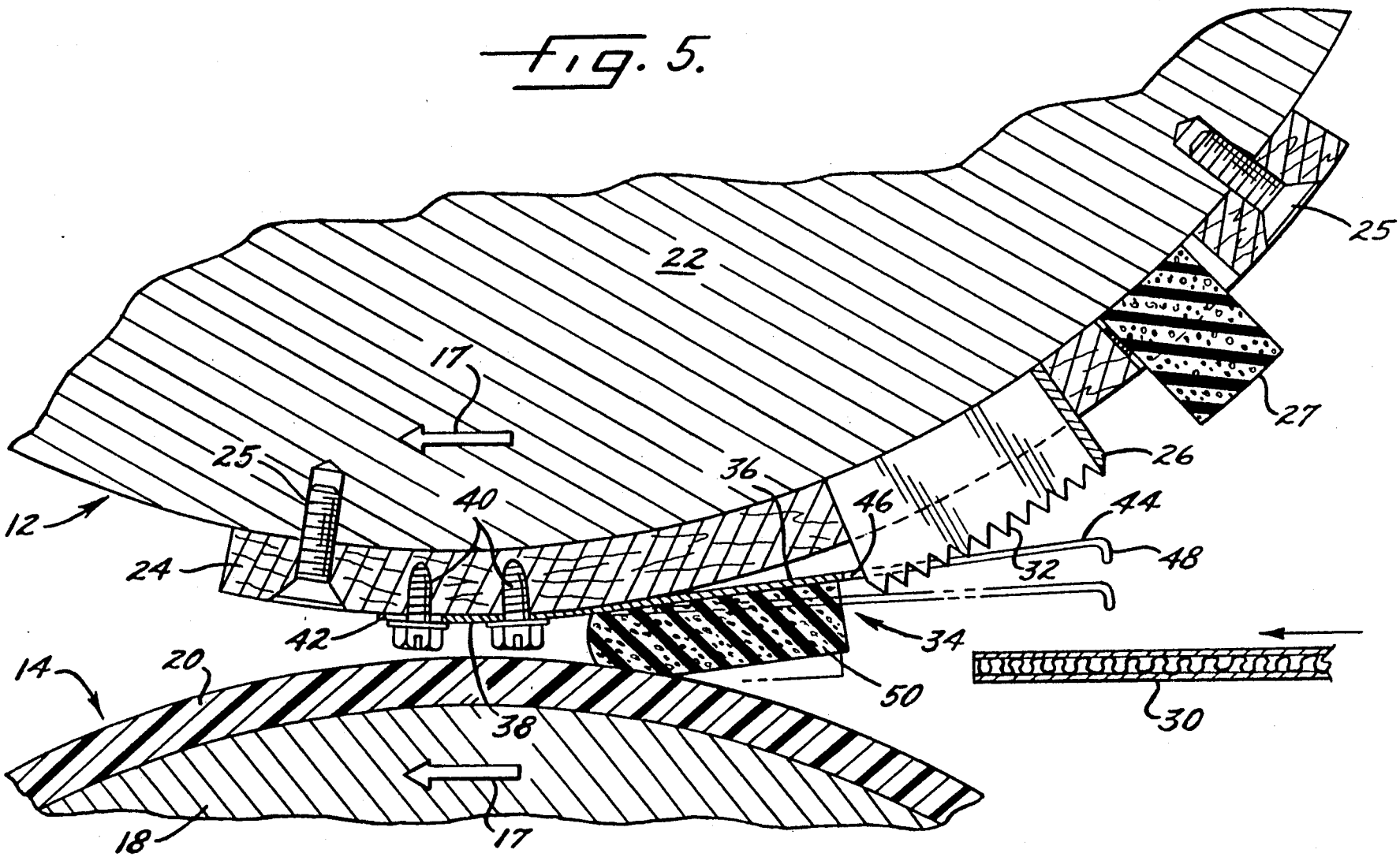
FIG. 5 is an enlarged fragmentary sectional view showing the scrap ejector and paperboard stock entering the nip between the die and anvil rolls of the apparatus.

The rotary die apparatus identified in its entirety in FIG. 1 by the numeral 1 includes a die roll 122 and an anvil roll is that are mounted by a suitable frame 26 in closely spaced parallel relationship to each other. During operation of apparatus 20, rolls 12, 14 are driven by appropriate drive means (not shown) in opposite angular directions as indicated by the arrows 17. Anvil roll 22 is of a conventional construction, consisting of a metal core 18 having a layer of urethane or similar material 22 upon its outer surface.

Die roll 12 includes an inner cylinder metallic member 22 and an arcuate die board 24 that overlies and is releasably secured by fasteners 25 to part of the outer surface of member 22. Die board 24 is customarily formed of wood, but may be made of other materials.

Figure 6:
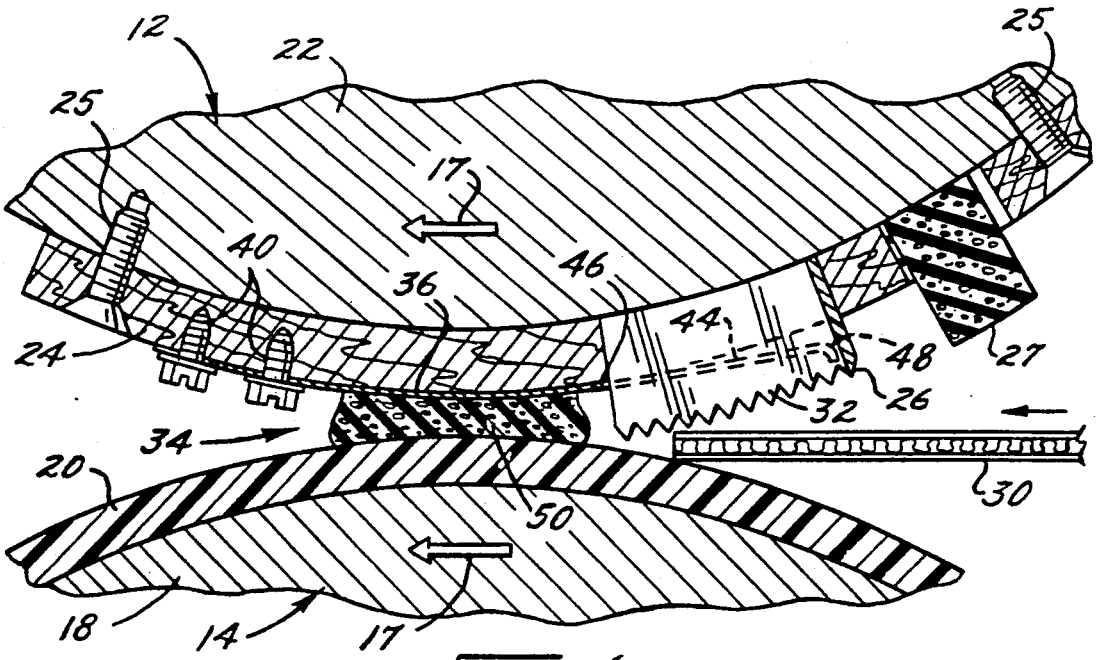
FIG. 6 is a view similar to FIG. 5 but showing the scrap ejector and the paperboard stock at locations further within the nip.

A toothed steel cutting rule 26 is mounted in a conventional manner within a slot of die board 24 and projects substantially radially outwardly from such board. A plurality of blocks 27 of product ejection rubber blocks customarily are mounted rearwardly (in relation to the direction of rotation of roll 12) of rule 26. Blocks 27 preferably are mounted in recesses within die board 24, as disclosed in a commonly owned U.S. Pat. Application filed 29 Apr. 1991 and entitled PRODUCT EJECTION MEANS FOR ROTARY DIE APPARATUS, and have their inner ends closely adjacent to, and preferably in engagement with, the arcuate surface of die roll member 22. Corrugated paperboard stock 30 (FIGS. 5-7) conducted by suitable feed rolls (not shown) during operation of apparatus 10 through the nip between rolls 22, 24 is pushed by blocks 27 away from die roll 12 and toward anvil 14. Cutting rule 26 illustratively extends substantially parallel to the central axis of die roll 22, and is adapted to "trim" (i.e., cut away) the leading edge portion 28 of the corrugated paperboard stock 30 conducted through the nip between rolls 12, 14. A plurality (illustratively three) of relatively short arcuate "trim breaker" rules 32 are mounted by die board 24 by spaced locations along the length of rule 26. Trim breakers 32 extend forwardly from cutting rule 26 and, as is well known to those skilled in the art, cut into shorter sections the scrap leading edge portion 28 trimmed from paperboard stock 30 by cutting rule 26.

In the FIGS. 1-4 and 5-7 embodiment of the invention, the aforesaid scrap paperboard material is ejected from apparatus 10 by a scrap ejector 34 associated with the center one of the illustrated three trim breakers 32. Ejector 32 includes a relatively long, thin, flexible and resilient body 36 formed of stainless steel or other suitable material. Ejector body 36 has a leading (in relation to the direction of rotation of die roll 12) end portion 38 that is fixedly secured to and upon the arcuate outer surface of die board 24 by a pair of screw type fasteners 40 that respectively extend through an adjustment slot 42 and a bore 43 provided within the aforesaid end portion of the body. In its unstressed condition shown in FIGS. 1-4, body 36 is substantially straight and extends substantially tangentially to the arcuate surface of die board 24. The opposite, trailing end portion 44 of body 36 then is spaced radially outwardly from the outer surface of die board 24. A slot 46 extends through and longitudinally of body portion 44 and opens from the trailing end thereof. The peripheral edges of body 36 are preferably smooth and rounded, as shown in FIG. 4. Trailing end portion 44 may and illustratively does have terminal flanges 48 that extend angularly away from die roll 12. Resiliently compressible and extendable means, which in the present embodiment is a pad 50 of closed cell rubber or other elastomer, is secured upon the medial portion of body 36 and projects outwardly from the surface thereof distal from die roll 12.

Figure 7:
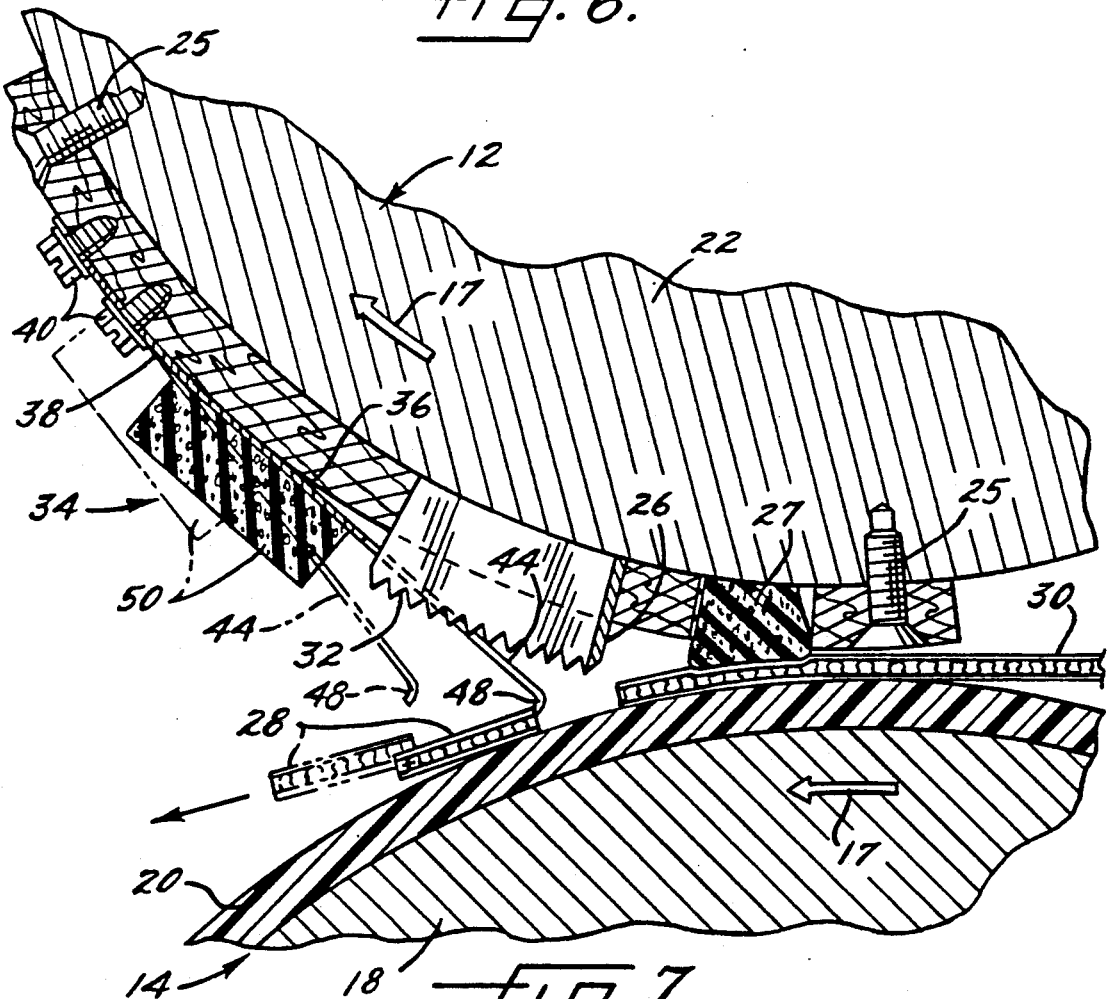
FIG. 7 is a view similar to FIGS. 5 and 6 but showing the scrap ejector, paperboard stock and a trimmed edge portion of the stock exiting from the nip.

As rotation of die roll 22 carries scrap ejector 34 into the nip between rolls 12, 14 (see FIGS. 5 and 6), engagement between pad 50 and anvil roll 14 forces the medial and trailing end portions of body 36 toward roll 22 to a retracted position wherein the flanged end of the body's trailing end portion 44 is adjacent the arcuate outer surface of die board 24 and the leading radially extending surface of cutting rule 26. In the latter regard, the previously mentioned slot 42 within the leading end portion 38 of body 36 facilitates initial longitudinal adjustment of the body to a location wherein flanges 48 are very close to, and preferably engage, the leading surface of rule 26 when body 36 occupies its retracted position of FIG. 6. As continued rotary movement of die roll 12 carries pad 50 from the nip between rolls 12, 14, as shown in FIG. 7, resilient return movement of the pad and body 36 causes its end portion 44 to again move outwardly. During such outward return movement, the trailing end portion 44 of body 36 engages the scrap material 28 cut from the leading end portion of paperboard stock 30 by rule 26, and ejects the same downwardly away from die roll 12 and the path of travel of the trimmed paperboard stock 30 passing through the nip. When present, the flanges 48 upon the trailing end portion of body 34 assist in realization of the foregoing desirable result.

The compressible nature of pad 50 lessens the shock forces imposed upon body 36 during its passage through the nip between rolls 12, 14, and also ensures that the desired scrap ejection will ensue even if the magnitude of the nip spacing between rolls 12, 14 should be other than optimum.

Figure 10:
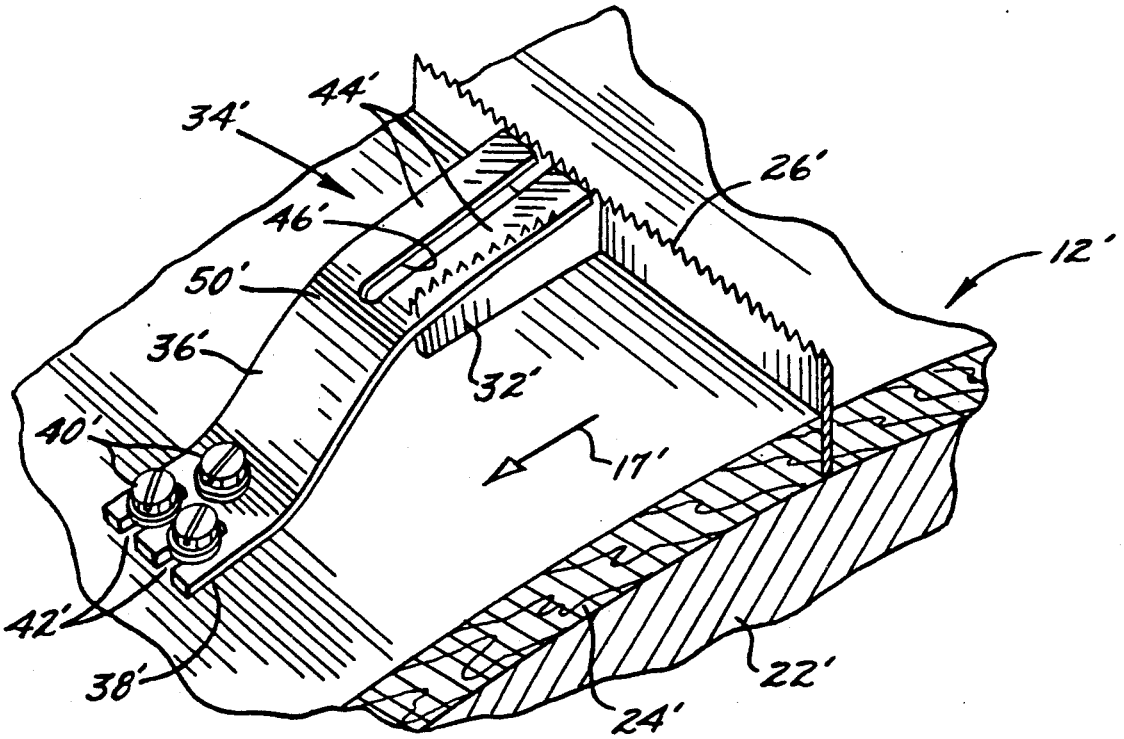
FIG. 10 is a top perspective view of another embodiment of the scrap ejector.
Figure 11:
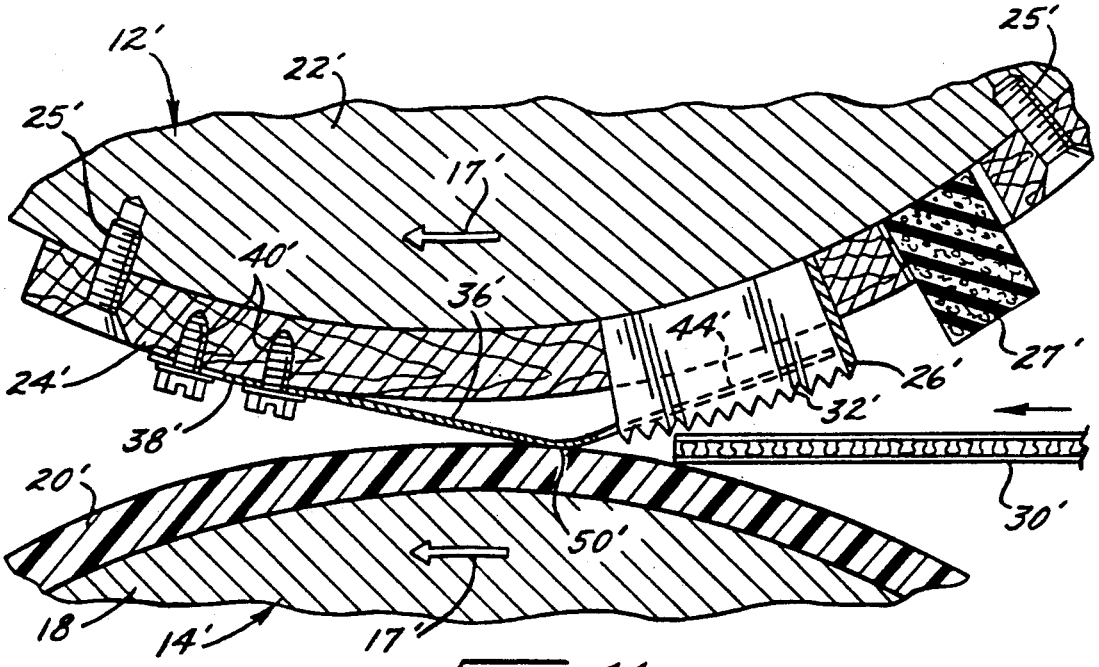
FIG. 11 is a view similar to FIG. 5 but showing the scrap ejector of FIG. 10.
Figure 12:
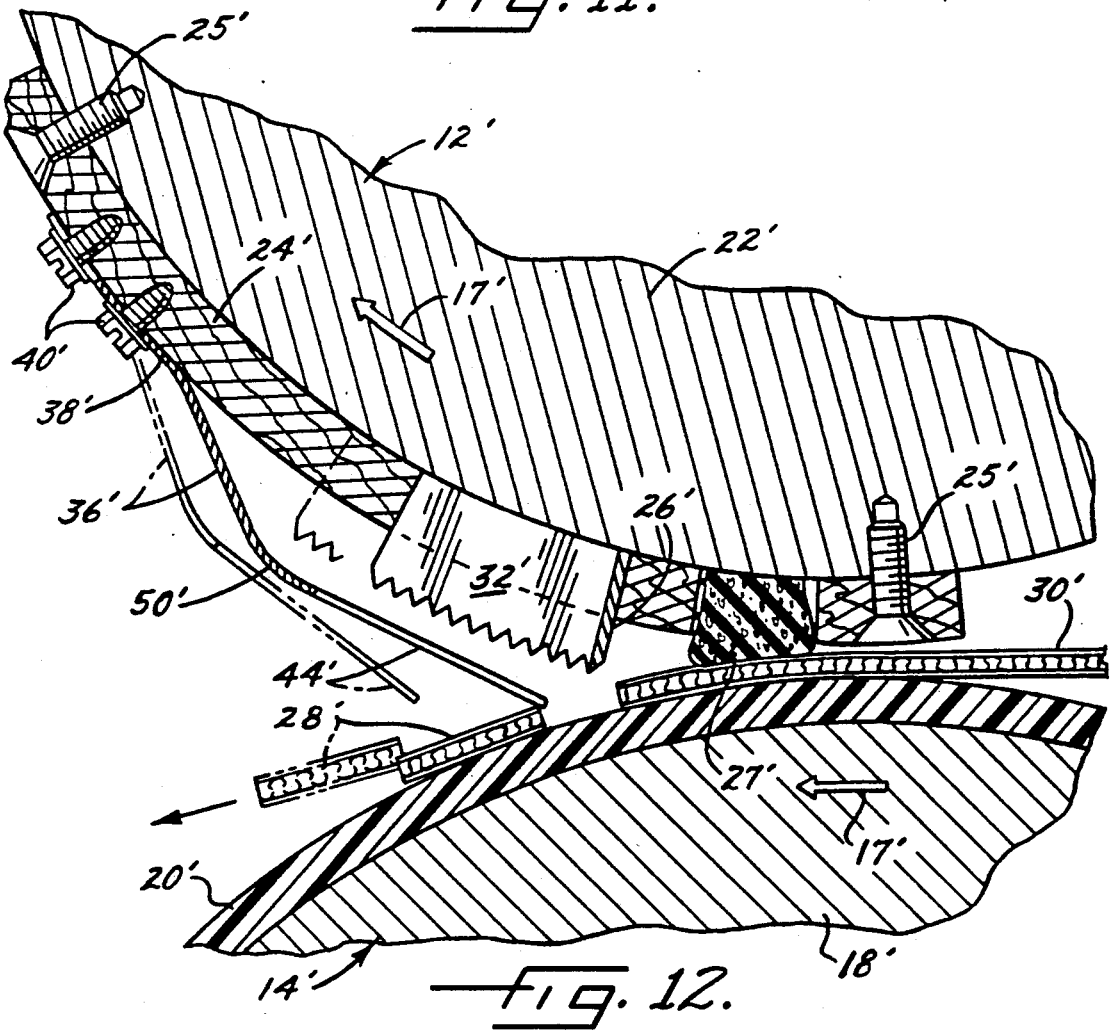
FIG. 12 is a view similar to FIG. 7 but showing the scrap ejector of FIG. 10.

In the alternative embodiment shown in FIGS. 10–12 of the drawings, the same reference numerals with the addition of a prime designation are used to identify components identical or similar to those previously described. The body 36' of ejector 34' may be formed of the same material and may be of the safe rounded-edge construction as the previously-discussed body 36. However, in its unstressed condition body 36' is curved, rather than substantially straight, and has intermediate its length an arcuate "hump" 50' that projects away from the surface of die roll 12'. The leading end portion 38' of body 36' overlies and is secured to die board 24' by fasteners 40, one of which extends through a bore and the remainder through adjustment slots 42', within body portion 38. Alternatively, body 36' may be mounted in any other suitable manner. The trailing end portion 44' of body 36' may (as shown) have a slot 46' comparable to slot 46 of body 36 and may (as shown) lack a flange at its end. The projecting hump 50' of body 36' performs a function similar to that performed by pad 50: i.e., engagement between hump 50' and anvil roll 14' during passage of body 36' into the nip between rolls 12', 14' deflects trailing end portion 44' of body 36' from its normal extended position, wherein it is disposed radially outwardly from die roll 12 and cutting rule 26, to a position wherein its trailing portion 44' is disposed closely adjacent roll 12' and rule 26'. Upon passage of ejector 34' from the nip, the resiliency of hump 50' and the adjacent portions of body 36' causes its trailing end portion 44' to spring outwardly and eject the cut away scrap paperboard in the same manner as previously described in connection with the first embodiment of the invention. When hump 50' is compressed, it undergoes deflection that reduces the shock forces upon the remainder of body 36'. However, such deflection may not produce the same degree of shock force reduction as does pad 50. Additionally, the aforesaid deflection of hump 50' "flattens" the hump to some extent. This, unlike the situation with pad 50, increases the length of body 36' somewhat, and such length extension must be taken into consideration during initial mounting of the body upon die board 24'.

Figure 8:
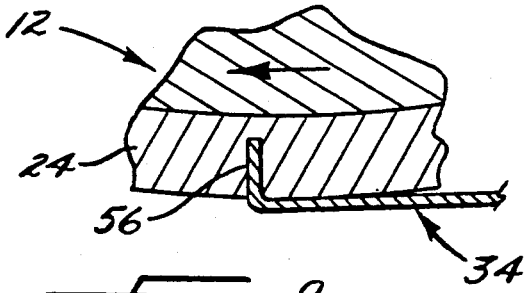
FIG. 8 is a fragmentary sectional view of an alternative construction of the leading end portion of the scrap ejector.
Figure 9:
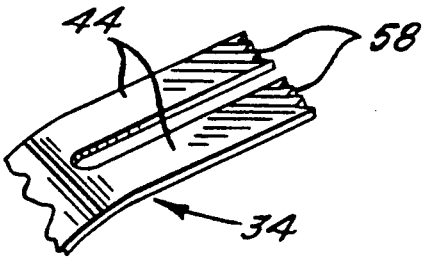
FIG. 9 is a fragmentary perspective view of an alternative construction of the trailing end portion of the scrap ejector.

Other embodiments of the invention are shown in FIGS. 8 and 9 of the drawings. In FIG. 8 the leading end of the main body of the scrap ejector has an inwardly extending mounting flange 56 that is secured, as by a friction fit and/or an adhesive within a slot of the die board. Flange 56 may be used in addition to or in lieu of the previously-described screw type fasteners to secure ejector 34 or 34' to the die board. FIG. 9 shows the trailing end of ejector 34 or 34' having a series of teeth 58, instead of having a flanged or "plain" end.

While specific embodiments of the invention have been shown and described, this was for purposes of illustration only, and not for purposes of limitation, the scope of the invention being in accordance with the following claims.

We claim:

1. A rotary die apparatus having a die roll and an anvil roll mounted in generally parallel relationship to each other for rotation in opposite directions and defining a nip therebetween, said die roll having a cutting rule extending outwardly from the outer surface of said roll for, in cooperation with said anvil roll, cutting material off of the leading edge portion of paperboard stock passing through said nip between said rolls; and a scrap ejector for ejecting said material away from said paperboard stock following cutting thereof, the improvement comprising:

said scrap ejector including an elongated flexible body having a leading end portion, a trailing end portion, and resilient compressible means projecting away from said die roll and toward said anvil roll, said leading end portion of said scrap ejector being connected to said die roll adjacent said outer surface thereof and passing through said nip between said rolls prior to said trailing end of said scrap ejector, said trailing end portion of said body of said scrap ejector normally being spaced outwardly from said outer surface of said die roll, and being movable toward said die roll surface by engagement of said resilient compressible means with said anvil roll during passage of said scrap ejector into said nip between said rolls.

2. Apparatus as in claim 1, wherein said resilient compressible means is intermediate said leading trailing end portions of said body.

3. Apparatus as in claim 1, wherein said body of said scrap ejector has a flange extending angularly from said leading end portion thereof.

4. Apparatus as in claim 1, wherein said body of said scrap ejector has a flange extending angularly from said trailing end portion thereof.

5. Apparatus as in claim 1, wherein said trailing end portion of said body of said scrap ejector has a toothed end.

6. Apparatus as in claim 1, wherein said body of said scrap ejector has smooth rounded edges.

7. Apparatus as in claim 6, wherein said body of said scrap ejector is formed of metal.

8. Apparatus as in claim 7, wherein said body of said scrap ejector is formed of stainless steel.

9. Apparatus as in claim 1, and further including a trim breaker extending forwardly from said cutting rule, and said body of said scrap ejector has a slot within said trailing end portion thereof for receiving said trim breaker when said trailing end portion of said body is adjacent said outer surface of said die roll.

10. Apparatus as in claim 1, wherein said leading end portion of said body of said scrap ejector has an adjustment slot extending longitudinally thereof and facilitating mounting of said body upon said die roll.

11. Apparatus as in any of the preceding claims, wherein said die roll includes an inner metallic cylindrical member, a die board mounted upon said inner cylindrical member, said die board having recesses therein, blocks of product ejection rubber mounted within respective ones of said recesses, each of said blocks of product ejection rubber extending outwardly from the associated one of said recesses beyond the outer surface of said die board and extending inwardly to locations closely adjacent the surface of said inner metallic cylindrical member.

12. Apparatus as in any of claims 1–10, wherein said body of said scrap ejector has, when in an unstressed condition, a curved portion intermediate said leading and trailing end portions of said body, and said resilient compressible means includes said curved portion of said body.

13. Apparatus as in claim 12, wherein said curved portion of said body engages said anvil roll during passage of said scrap ejector into said nip between said rolls, and said engagement moves said trailing end portion of said body generally radially inwardly toward said outer surface of said die roll and generally longitudinally toward the leading surface of said cutting rule.

14. Apparatus as in any of claims 1–10, wherein said body of said scrap ejector is substantially straight when in an unstressed condition, and assumes an arcuate shape during passage through said nip between said rolls.

15. Apparatus as in claim 14, wherein said resilient compressible means is a block of elastomeric material.

16. Apparatus as in claim 15, wherein said elastomeric material is closed cell rubber.

* * * * *

UNITED STATES PATENT AND TRADEMARK OFFICE

CERTIFICATE OF CORRECTION

PATENT NO. : 5,111,725

DATED : May 12, 1992

INVENTOR(S) : Simpson et al.

It is certified that error appears in the above-identified patent and that said Letters Patent is hereby corrected as shown below:

Col. 2, Line 60, "roll" should read --rolls--

Col. 4, Line 5, "numeral 1" should read --numberal 10--

Col. 4, Line 5, "122" should read --12--

Col. 4, Line 6, "roll is" should read --roll 14--.

Col. 4, Line 6, "26" should read --16--

Col. 4, Line 8, "20" should read --10--

Col. 4, Line 11, "22" should read --12--

Col. 4, Line 13, "22" should read --20--

Col. 4, Line 34, "22,24" should read --12,14--

Col. 4, Line 37, "22" should read --12--

Col. 4, Line 52, "32" should read --34--

Col. 5, Line 9 , "22" should read --12--

Col. 5, Line 12, "22" should read --12--

Col. 5, Line 46, "safe" should read --same--

Col. 5, Line 53, "40" should read --40'--

UNITED STATES PATENT AND TRADEMARK OFFICE

CERTIFICATE OF CORRECTION

PATENT NO. : 5,111,725

DATED : May 12, 1992

INVENTOR(S) : Jack R. Simpson

It is certified that error appears in the above-identified patent and that said Letters Patent is hereby corrected as shown below:

Column 6, line 58, "leading trailing" should read --leading and trailing--.

Signed and Sealed this

Seventeenth Day of August, 1993

*Attest:*

Bruce Lehman

BRUCE LEHMAN

*Attesting Officer*

*Commissioner of Patents and Trademarks*